US005696364A

United States Patent [19]

Stroud et al.

[11] Patent Number: 5,696,364

[45] Date of Patent: Dec. 9, 1997

[54] COMBINED INTERRUPTER DISCONNECT SWITCH BLADE FOR HIGH VOLTAGE SWITCH

[75] Inventors: Nicholas J. Stroud, Greensburg; Tomas Otterberg, Murrysville, both of Pa.

[73] Assignee: ABB Power T&D Company Inc., Raleigh, N.C.

[21] Appl. No.: 261,671

[22] Filed: Jun. 17, 1994

Related U.S. Application Data

[63] Continuation of Ser. No. 990,010, Dec. 14, 1992, abandoned.

[51] Int. Cl.[6] ..... H01H 33/14; H01H 33/59; H01H 33/70

[52] U.S. Cl. ..... 218/2; 218/7; 218/45; 218/67; 218/84

[58] Field of Search ..... 218/1, 2–8, 43–88, 218/153, 154; 200/48 R–48 CB

[56] References Cited

U.S. PATENT DOCUMENTS

| | | | |
|---|---|---|---|
| 3,674,956 | 7/1972 | Erni | 218/67 |
| 4,319,105 | 3/1982 | Lott et al. | 218/57 |
| 4,752,859 | 6/1988 | Chabala et al. | 361/602 |
| 4,983,792 | 1/1991 | Rogers et al. | 218/84 |

FOREIGN PATENT DOCUMENTS

| | | | |
|---|---|---|---|
| 1156141 | 3/1964 | Germany | H01H 33/12 |
| 1028719 | 5/1966 | United Kingdom | H01H 33/12 |

*Primary Examiner*—J. R. Scott

*Attorney, Agent, or Firm*—Woodcock Washburn Kurtz Mackiewicz & Norris LLP

[57] ABSTRACT

A high voltage open-air switch has a movable disconnect switch blade which contains a circuit interrupter therein having interrupter contacts in series with the open air disconnect switch contacts. The circuit interrupter has a lower BIL rating than the switch. An operating mechanism causes the independent operation of the interrupter and disconnect switch such that there is a high speed opening of the interrupter contacts, followed by the low speed opening of the disconnect switch contacts, and a slow speed closing of the disconnect switch contacts followed by the high speed closing of the interrupter contacts. The switch can be adapted to numerous switch configurations and permits substantial savings in space by the reduced mounting space requirements for the interrupter assembly.

15 Claims, 11 Drawing Sheets

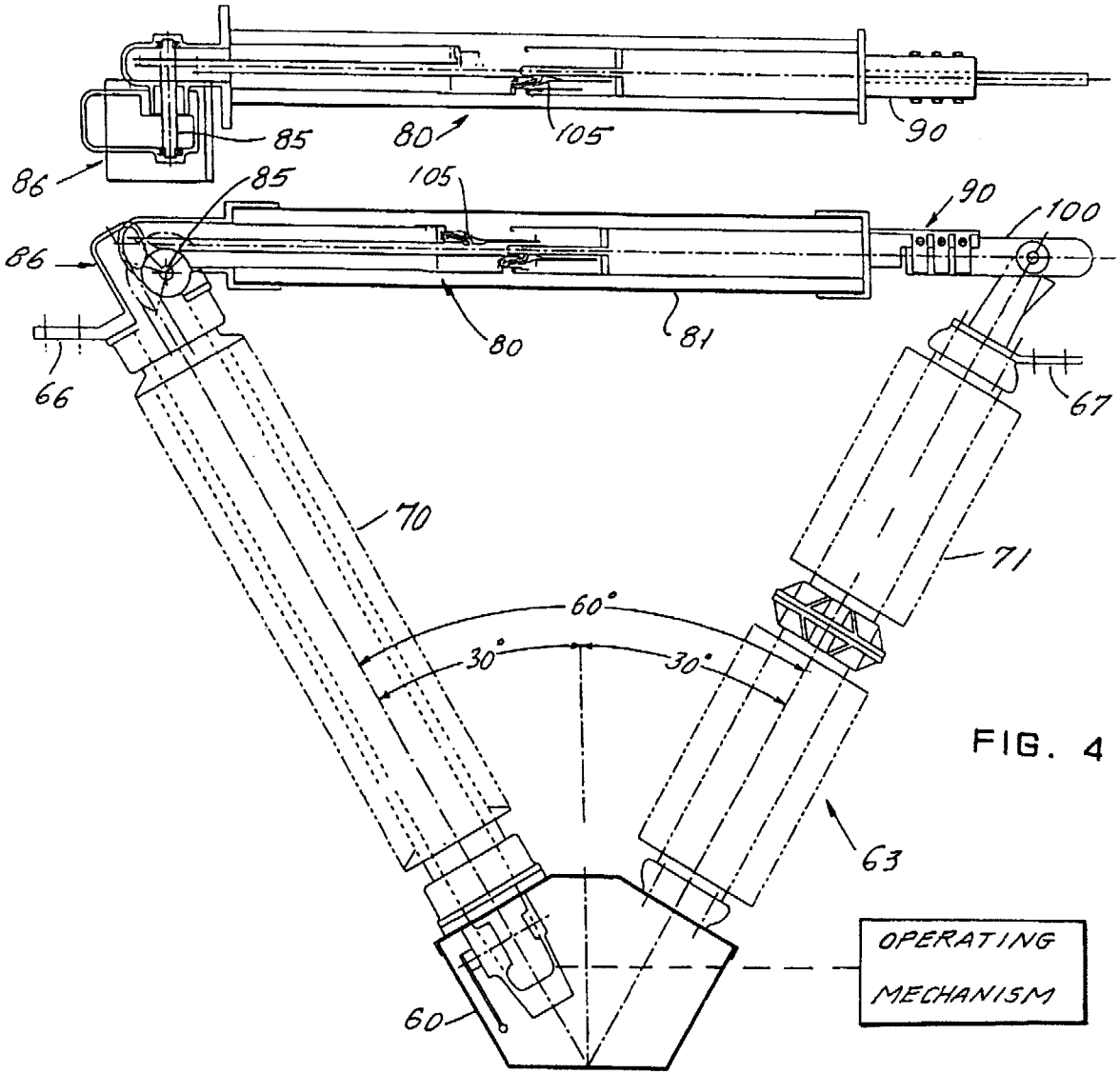
FIG. 4
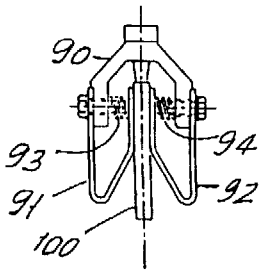
FIG. 6
FIG. 5

MECHANISM CHARACTERISTIC-CLOSING

MECHANISM CHARACTERISTIC-OPENING

COMBINED INTERRUPTER DISCONNECT SWITCH BLADE FOR HIGH VOLTAGE SWITCH

This is a continuation of application Ser. No. 07/990,010, filed on Dec. 14, 1992, now abandoned.

BACKGROUND OF THE INVENTION

This invention relates to high voltage switches, for example, switches capable of being used in lines of 69 kV and higher, and more specifically relates to high voltage switches having an interrupting capability and which are less expensive and which occupy less space than known combinations of interrupters and disconnect switches.

High voltage electrical power distribution systems need a means for interrupting load currents to control and switch the system. Discrete circuit breakers are generally used in such systems to interrupt line and fault currents. A circuit breaker is designed to interrupt a broad range of current from near zero current to large fault currents which could cause severe damage to the power system if not interrupted quickly. A disconnect switch is generally placed on one or both sides of the circuit breaker to provide a large air gap in the power line and to provide visual evidence that a line is disconnected from the power system. The disconnect switch generally has a very limited capability to interrupt current and operates relatively slowly. Thus, interrupter structures are frequently connected in series with disconnect switches to open before and close after the disconnect switch contacts open and close, respectively.

Disconnect switch and interrupter assemblies are known, sometimes termed "circuit switchers", in which both are integrated into a single mounted device. The interrupter subassembly is connected in series with the disconnect switch and mounted separately from the disconnect switch, employing its own support insulators. Thus, the assembly occupies considerable land area within a switching station and the equipment cost is relatively high.

SUMMARY OF THE INVENTION

In accordance with the present invention, the circuit interrupter and the disconnect switch functions are combined into a single device having the same size as the disconnect switch alone, while the assembly is capable of quickly interrupting line current and thereafter providing a large open air gap between the disconnect switch high voltage terminals. In the preferred embodiment, an interrupter structure is fixed within and forms a part of the movable blade of the disconnect switch. Thus, an interrupter module of any desired structure may be placed inside an elongated insulation tube which is fixed within and rotates with and forms a part of the disconnect switch contact blade.

The interrupter module carries the normal load current of the power system between the terminals of the device. An operating mechanism and linkage is provided to operate the interrupter module contacts and the disconnect switch arm contacts separately such that, when the device is operated to open the power circuit, the interrupter quickly opens first, interrupting the flow of any current and providing a small insulating gap that will withstand system recovery voltage. Then, the insulating tube/disconnect switch arm rotates about one of its ends and opens to create a large air gap between the high voltage terminals of the switch assembly. During the closing operation, the insulating tube disconnect switch blade rotates closed and then the interrupter contacts close to re-connect the power system and allow normal current flow through the device.

The invention is applicable to a vertical or horizontal disconnect arm motion and can be arranged in common disconnect switch configurations including, but not limited to, a side rotation, a two-arm center break design using side rotation or a lifting arrangement, and a double-arm, center pivot design.

The interrupter assembly can have any desired design and, for example, can be a standard type of puffer interrupter employing a high dielectric gas such as $SF_6$. Its housing may be a simple insulation tube rather than porcelain sheds, and its BIL rating (full wave withstand crest rating) may be lower, for example, by 25% of the BIL of the disconnect switch, thus reducing the mass of the interrupter.

Other features and advantages of the present invention will become apparent from the following description of the invention which refers to the accompanying drawings.

BRIEF DESCRIPTION OF THE DRAWINGS

FIG. 4 is an enlarged view of the switch portion of FIG. 2.

FIG. 5 is a top view of the interrupter switch and arm portion of FIG. 4.

FIG. 6 is an end view of the jaw contact of FIG. 4.

DETAILED DESCRIPTION OF THE DRAWINGS

Figure 1:
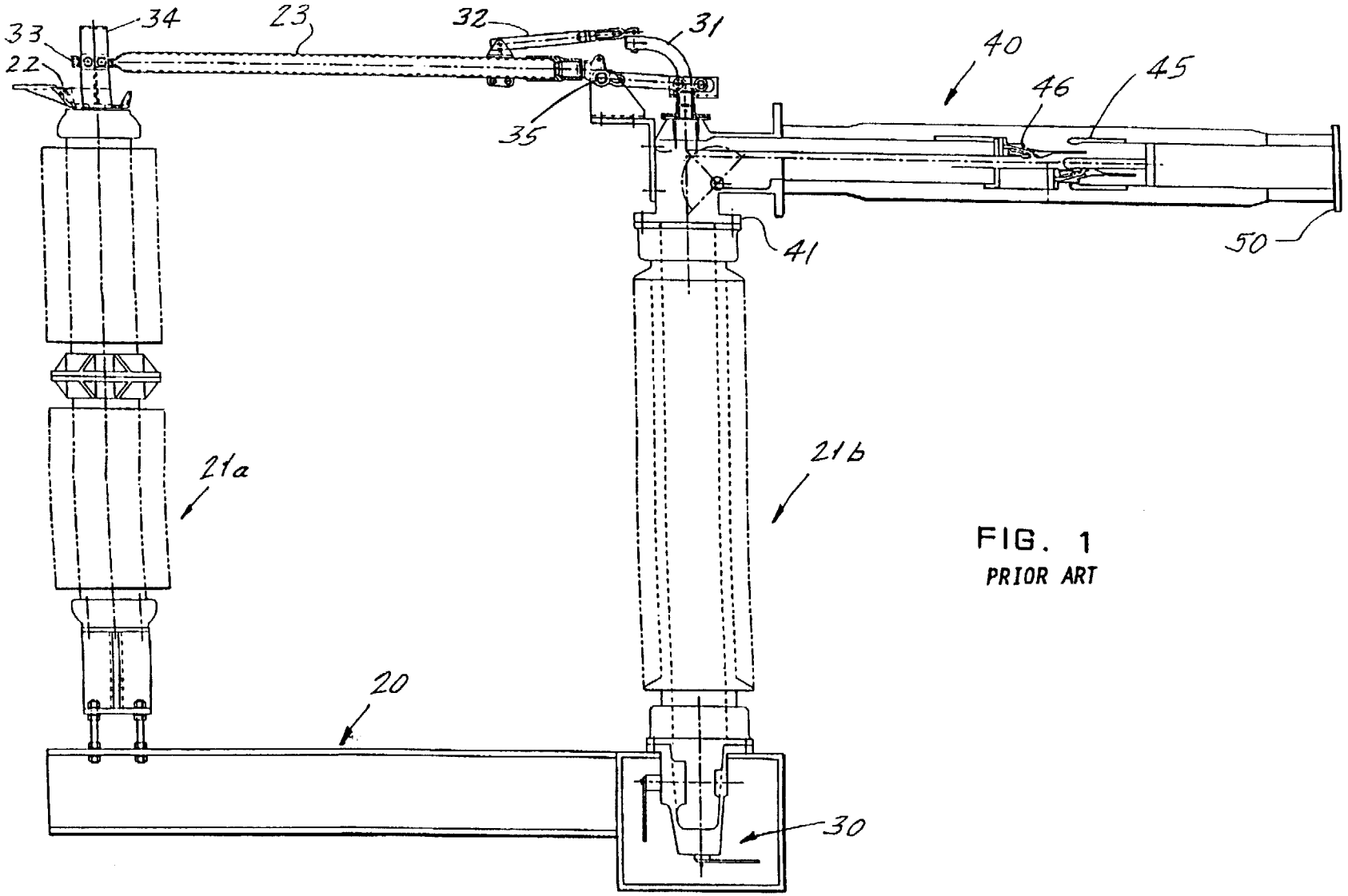
FIG. 1 PRIOR ART
FIG. 1 is an elevation drawing of an interrupter/disconnect switch assembly of the prior art.

Referring first to FIG. 1, a prior art switch assembly is shown, in which a horizontal support frame 20 receives a first vertical insulator support 21a and a second insulator support 21b. The disconnect switch shown in FIG. 1 could be a type TTR-6 sold by the assignee of the present invention. A conventional jaw contact and terminal 22 is fixed atop insulator 21a, and a rotatable contact arm or blade 23 is pivotally mounted atop insulator support 21b. An operating mechanism 30 has a rotatable rod operator extending through the center of insulator support 21b and connected to an operating crank arm 31 which, through linkage 32, causes blade 23 to first rotate about its longitudinal axis so that its flattened contact end 33 rotates out of high pressure contact within contact jaw 34, and to thereafter rotate clockwise about pivot 35 to its open gap position.

In order to add circuit interruption capability to the disconnect switch of FIG. 1, it is known to add an interrupter assembly 40 to the disconnect switch. The interrupter 40 is mounted in cantilever from a support casting 41 atop insulator support 21a. Interrupter 40 may be a conventional interrupter of the gas puffer type and contains a stationary main contact 45 and a movable contact 46 (shown open above the interrupter center line and closed below the interrupter center line). An operating mechanism (not shown) is connected to the movable contact to move it between its open and closed positions in response to the operation of mechanism 30. The free end of interrupter 40 has a switch terminal 50 connected thereto.

The assembly of FIG. 1, sometimes termed a "circuit switcher", occupies considerable space in a switching station. Moreover, the interrupter 40 is contained within a porcelain housing which may contain porcelain sheds, and the interrupter is designed to have the same BIL rating as the switch.

In accordance with the present invention, the interrupter subassembly of a circuit switcher type device is contained within and forms at least a part of the disconnect switch blade. In this way, the interrupter and switch blade occupy the same space, so that considerable substation space and cost will be saved. The new switch assembly of the invention can replace an existing disconnect switch, but adds the current interruption feature without requiring additional substation space. Greater land use efficiency, lower cost, and increased flexibility in modifying and up-rating existing installations results from the new subassembly.

Figures 2, 3:
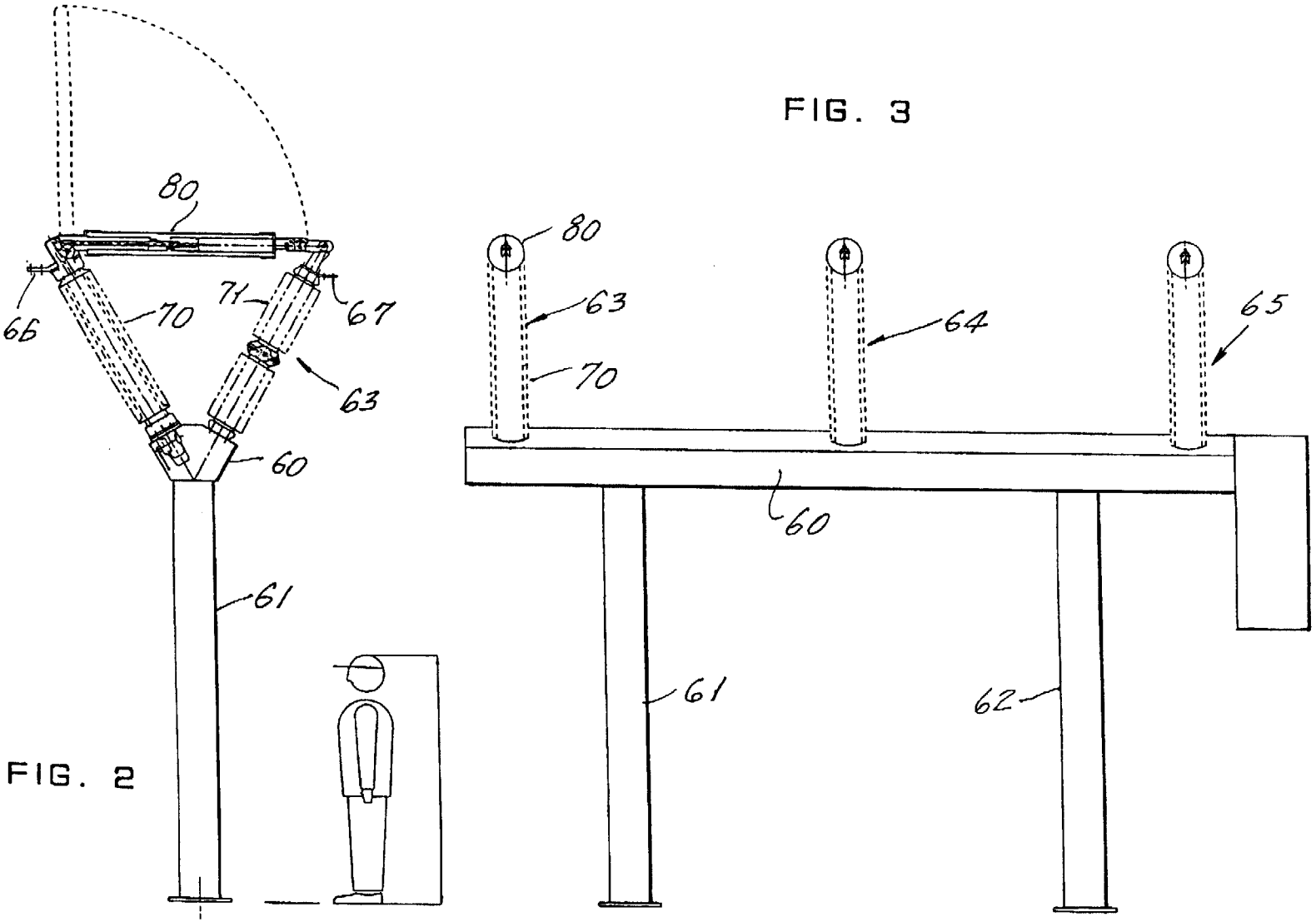
FIG. 2 is an elevation view of a three-phase switch assembly made in accordance with the present invention.
FIG. 3 is a side view of FIG. 2.

FIGS. 2 through 6 show a first embodiment of a switch assembly employing the present invention. Referring first to FIGS. 2 and 3, there is shown a three-phase switch assembly which comprises a horizontal support structure 60 mounted at the top of insulation support posts 61 and 62 (FIGS. 2 and 3). Three identical switch assemblies are mounted atop support structure 60, each providing a pair of main terminals for a respective phase. Terminals 66 and 67 are shown for the switch assembly 63.

FIGS. 4, 5 and 6 show the structure of switch 63 in more detail. Thus, two stationary support insulators 70 and 71 are supported by support base structure 61 and extend outwardly within a common plane, each at an angle of 30° to the vertical. Terminals 66 and 67 are carried at the ends of insulators 70 and 71, respectively.

An interrupter structure 80 is then provided, contained within a rigid insulation tube 81 of weight less than the conventional porcelain tube enclosure. The interior mechanism of the interrupter is the same as that of the interrupter 40 of FIG. 1 and may be a standard $SF_6$ puffer interrupter.

The BIL rating, that is, the full wave withstand crest rating of the interrupter 80 can, in accordance with the invention, be safely reduced from about 650 kV to about 488 kV for a 145 kV, 20 KA switch assembly. In a circuit switcher application, the interrupter has always been designed to have a full BIL rating. However, when combined with a disconnect switch, the interrupter need hold off voltage for only about one second and until the disconnect switch opens. The likelihood of a lightning strike or voltage surge on the line during that one-second period is so unlikely that it can be ignored, permitting a safe reduction in the mass of the interrupter. Note that any voltage surge which occurs during that one-second period would be cleared by circuit breakers in the system.

The left-hand end of interrupter 80 is pivotally mounted about the pivot 85 within the casting assembly 86 fixed to the upper end of insulator 70. The terminal 66 extends from the casting 86. The opposite end of the interrupter housing carries a spring-biased jaw contact section 90 (shown in FIGS. 4, 5 and 6) where enlarged-scale FIG. 6 shows that the jaw contact contains two spring-type contact members 91 and 92 which are pressed toward one another by appropriate springs 93 and 94, respectively.

The jaw contact 90 is shown in FIGS. 4, 5 and 6 as in engagement with a blade section 100 which is fixed to the terminal end 67 of insulator 63. The contacts 91 and 92 press against the opposite surfaces of the blade 100 when the rotatable interrupter structure 80 is rotated clockwise to the closed position illustrated in FIGS. 4, 5 and 6.

An operating mechanism which may be of any desired type is contained within the housing 60, as schematically illustrated in FIG. 4 and, in response to its actuation, will initially move a suitable linkage connected to the movable contact 105 of the interrupter structure 81 to initially open the interrupter contact at high speed to interrupt the current flowing to the circuit between terminals 66 and 67. Once the contacts are open, the operating mechanism continues at slow speed to begin to rotate the entire interrupter assembly 80 counterclockwise about pivot 85, thereby to open a large air gap between the jaw contact 90 and the stationary contact blade 100, with the interrupter assembly 80 rotating to a vertical position.

Figure 4A:
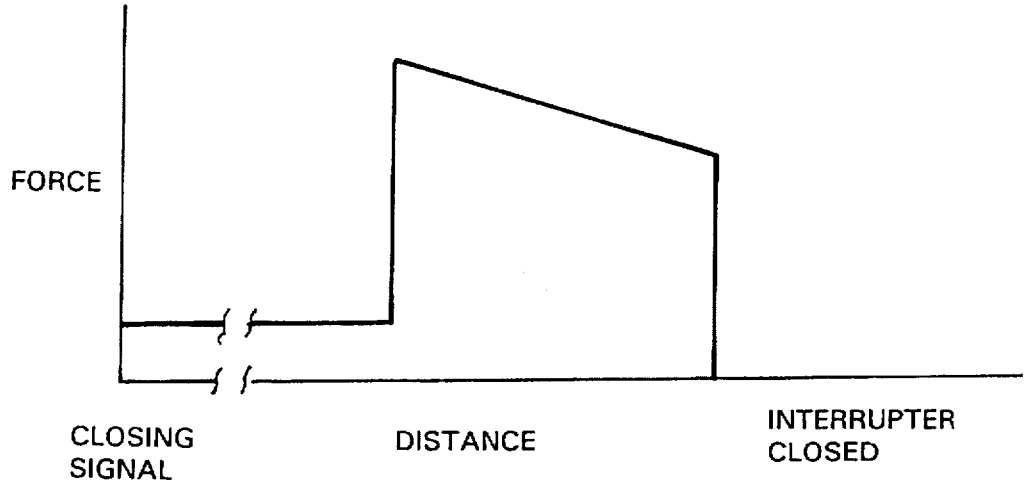
FIG. 4*a* shows the force-versus-distance characteristic for the operating mechanism during the closing of the interrupter and disconnect switch contacts.
Figure 4B:
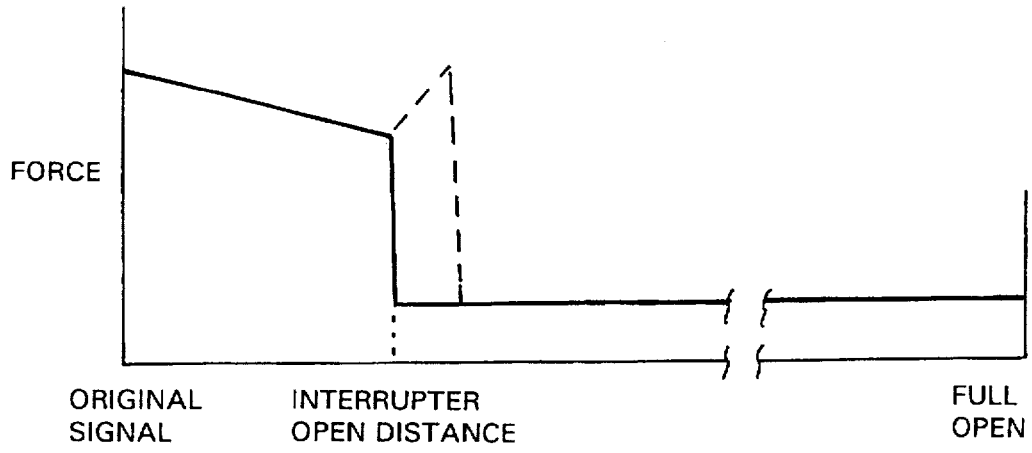
FIG. 4*b* shows the operating mechanism characteristic in terms of force versus distance (or movement of the operating linkage) during the opening operation of the interrupter and disconnect switch contacts.

The characteristic of the operating mechanism of FIG. 4 is best illustrated in FIGS. 4*a* and 4*b* and could take any desired mechanical format which will be apparent to those skilled in the art.

During the opening operation of the device in the position of FIG. 4, the characteristic of force versus distance or the movement of the operating link of the operating mechanism which causes initial motion of the interrupter and subsequent motion of the rotating interrupting assembly 80 is shown in FIG. 4*b*. Once a signal is applied to the operating mechanism at the point labeled "opening signal", the mechanism initially applies a high force to the interrupter structure only for moving contact 105 to its open position at relatively high speed, represented by the relatively short distance between the opening signal and the point at which the interrupter is open. At that instant, the force from the operating mechanism decreases substantially to the constant level shown to begin to rotate the interrupter assembly 80 counterclockwise to its fully open position. If desired, and as schematically illustrated in dotted lines, an initial high force can be applied to the interrupter assembly 80 for rotation of the interrupter assembly in order to break the jaw and blade contacts 90 and 100, respectively, away from one another in the event of icing or the like, with the force then dropping off to the low constant force for relatively slow rotation of the interrupter assembly 80 to its fully open position.

FIG. 4*a* shows the characteristic of the mechanism for closing, first the disconnect switch and then the interrupter assembly. Thus, in FIG. 4*a*, at the closing signal, a relatively low force is applied to the rotating assembly 80, causing it to rotate toward the closed position over a relatively long period of time, schematically illustrated by the break in the distance direction of FIG. 4*a*. Immediately upon the closing of the disconnect switch contacts 90 and 100, the operating mechanism applies a high force for the high speed operation of the interrupter contacts to their closed position so that all closing duty is taken by the interrupter assembly until the interrupter reaches the interrupter-closed position and the entire circuit switcher is closed.

It will be observed that the novel assembly of FIGS. 2 through 6 will occupy substantially less space within the substation than a structure in which the interrupter structure is mounted separately as in FIG. 1, and requires its own space within the interrupter assembly.

The concept of the invention can be carried out in many different geometries. Thus, the arrangement, for example, of FIG. 4, which can be characterized as a V-type geometry, can also be carried out in a geometry known as an N-type geometry, in which the insulators supporting the disconnect switch blade and, in the case of the invention, the movable interrupter assembly, are vertical and parallel, as shown in FIGS. 7, 8, 9 and 10.

Figure 8:
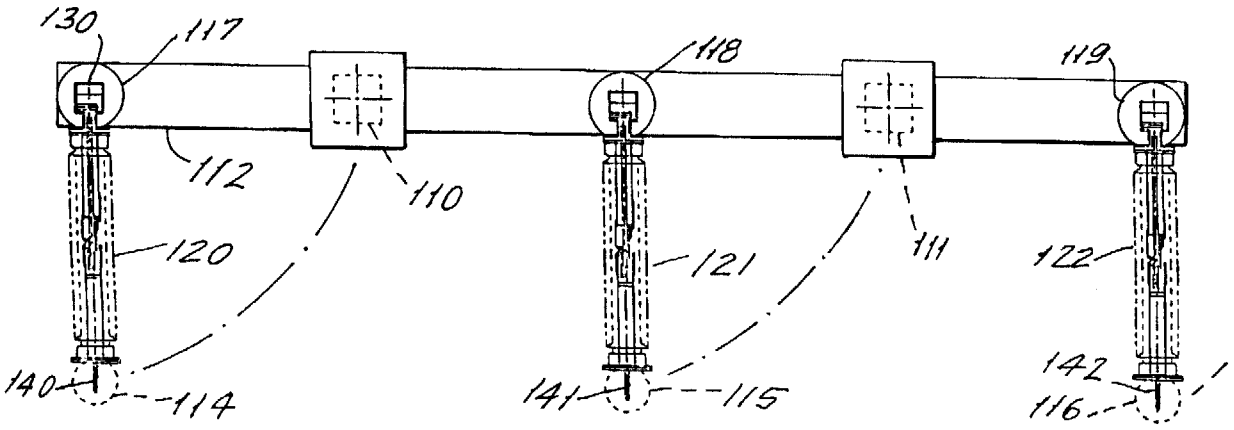
FIG. 8 is a side view of FIG. 7.
Figure 7:
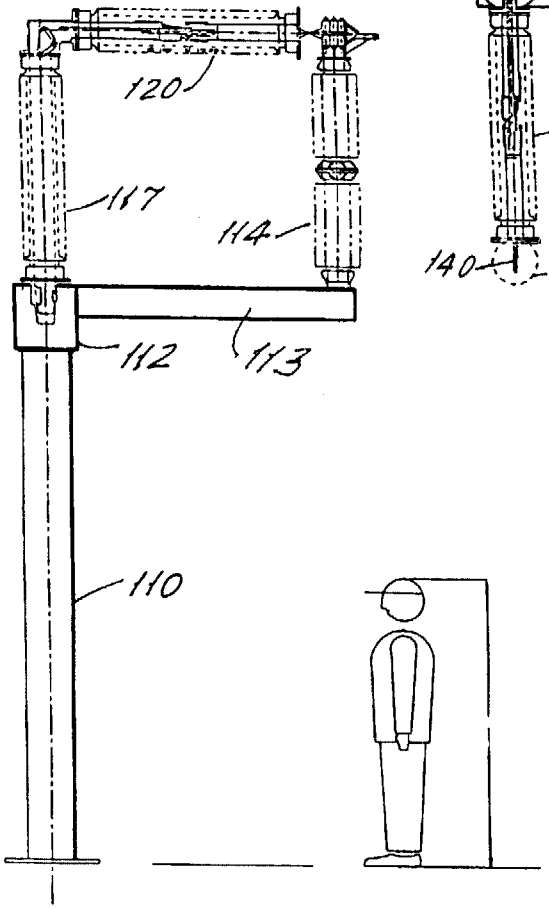
FIG. 7 is an elevation view of a second embodiment of the invention.
Figure 10:
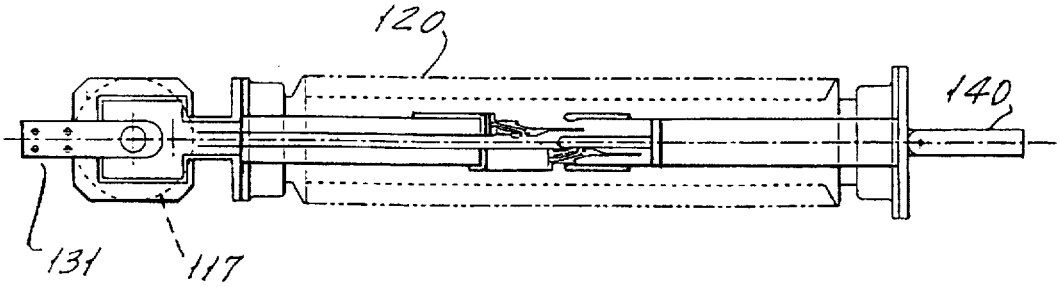
FIG. 10 is a top view of the rotating arm of FIG. 9.

Referring next to FIGS. 7 and 8, there is shown therein the provision of two support tubes 110 and 111 for supporting the assembly from the ground. A horizontal support beam 112 is mounted across the tops of support tubes 110 and 111. For a three-phase unit, perpendicular support beams, such as the beam 113, project from the horizontal support beam 112, so as to support fixed vertical insulator columns 114, 115 and 116 (FIG. 8). The horizontal support beam 112 itself then supports cooperating but rotatable vertical insulator columns 117, 118 and 119, wherein insulator pairs 114 and 117, 115 and 118, and 116 and 119 physically support the disconnect switch and interrupter of a respective phase of the three-phase circuit switcher shown in FIGS. 7 and 8.

Figure 9:
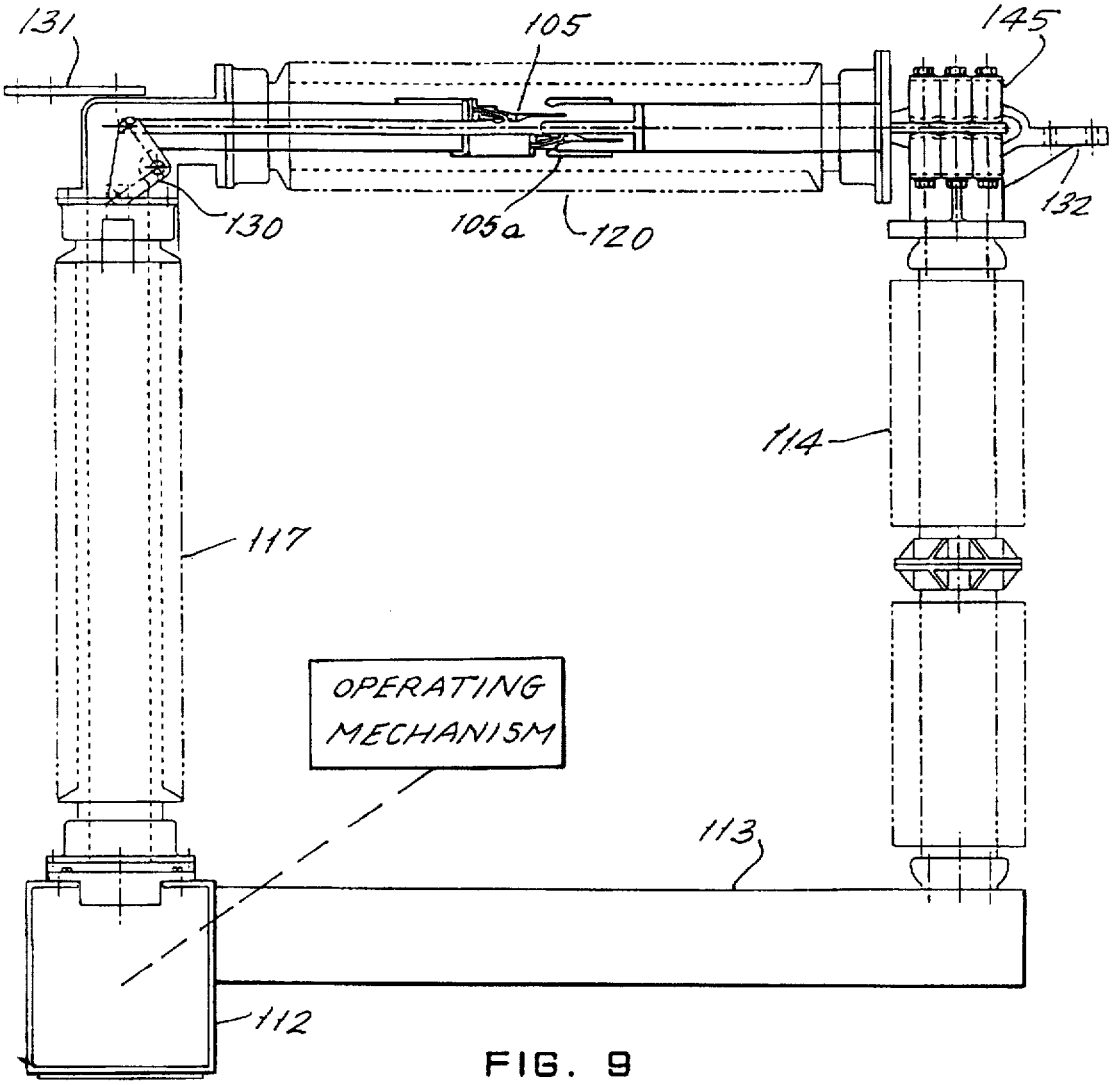
FIG. 9 is an enlarged view of the switch assembly of FIG. 7.

Interrupter structures 120, 121 and 122 are then associated with each of the pairs of insulators 114–117, 115–118 and 116–119, respectively, as shown in FIGS. 7, 8 and 9. Interrupters 120, 121 and 122 may have the same structure as the interrupter assembly 81, previously shown in connection with FIGS. 2 through 6.

An operating mechanism is provided for the assembly of FIGS. 7 through 10, shown schematically in FIG. 9, where the operating mechanism operates a shaft extending along the center of insulators 117, 118 and 119, extending to the crank arm 130. The crank arm 130 is operated at high speed for operating the movable and fixed interrupter contacts of interrupter assembly 120, including the movable interrupter contact 105 and the fixed interrupter contact 105a as shown in FIG. 9, at high speed to open and close the circuit which is connected between, for example, the terminals 131 and 132 for the phase containing interrupter 120 and the movable and fixed contacts 105, 105a.

The interrupter assemblies 120, 121 and 122 are also fixed to the top of their respective rotatable support insulators 117, 118 and 119, whereby rotation of the insulator columns 117, 118 and 119 will tend to rotate the interrupter assemblies about the central axis of the rotating insulators and in a direction shown by the dotted lines in FIG. 8. The operating mechanism causes this rotational movement of each of the insulator supports 117, 118 and 119 through a suitable mechanical connection (not shown) following the opening of the interrupter contacts of interrupters 120, 121 and 122, with the rotational motion of the interrupter 120 proceeding at a relatively slow speed, such that the interrupter assembly is rotatably moved to its fully open position in about one second.

The disconnect switch portion of the assembly of FIGS. 7 through 10 consists of a contact blade 140 fixed to the free end of interrupter 120 and similar blades 141 and 142 for interrupters 121 and 122 of FIG. 8. These blades engage a jaw contact assembly, typically shown in FIG. 9 as the jaw contact assembly 145, which consists of spring-biased contacts pressed toward one another and into engagement with the blade 140 when the interrupter structure 120 is rotated to its closed position. The same operating mechanism characteristic shown in FIGS. 4*a* and 4*b* can be used for the operating mechanism of FIGS. 7, 8 and 9, and the same advantages of substantial space saving within a switching substation are achieved by using the interrupter structure as a portion of the disconnect switch blade of a conventional disconnect switch structure.

Figure 11:
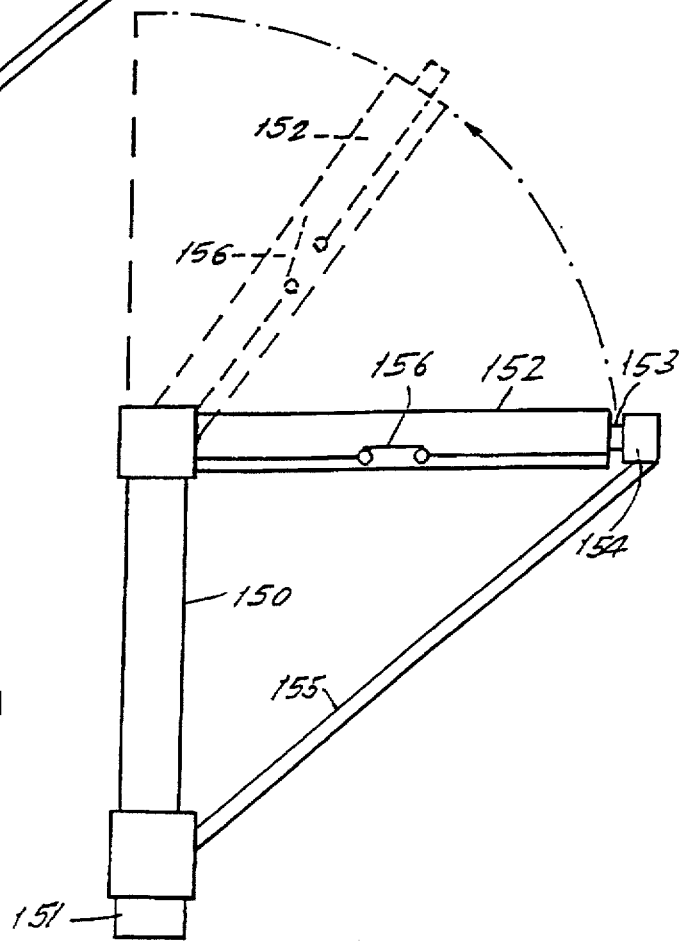
FIG. 11 schematically illustrates the use of the invention in a vertical break switch.

A large number of other switch assembly layouts can benefit from the use of the invention, wherein the interrupter structure is employed as at least a portion of the disconnect switch blade of a disconnect switch. For example, FIG. 11 schematically illustrates the invention as applied to a vertical break switch in which a vertical support insulator 150 extends upwardly from a stand 151 to pivotally support the end of an interrupter assembly 152 which has a blade 153 engageable with a jaw contact terminal 154. A diagonal support insulator 155 completes the essential assembly. It will be apparent that, when the assembly is operated, the interrupter contacts 156 will first open and thereafter the assembly will rotate as shown in the dotted-line position to its open position. The interrupter will interrupt current before the insulating tube/blade assembly 152 will open to create a large air gap clearance between the terminals.

Figure 13:
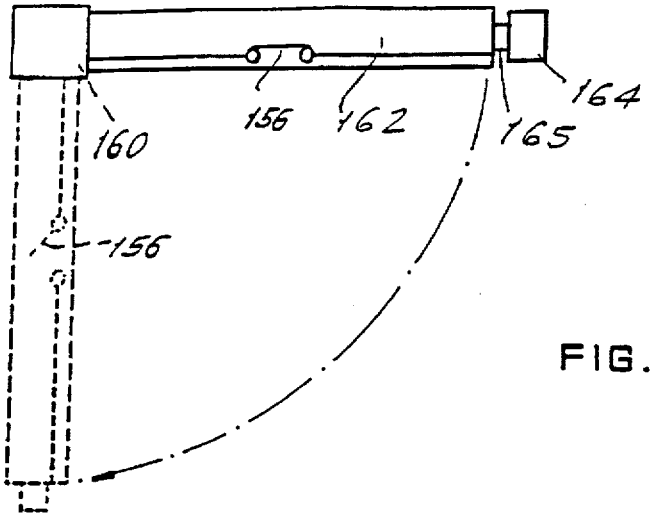
FIG. 13 is a top view of FIG. 12.
Figure 12:
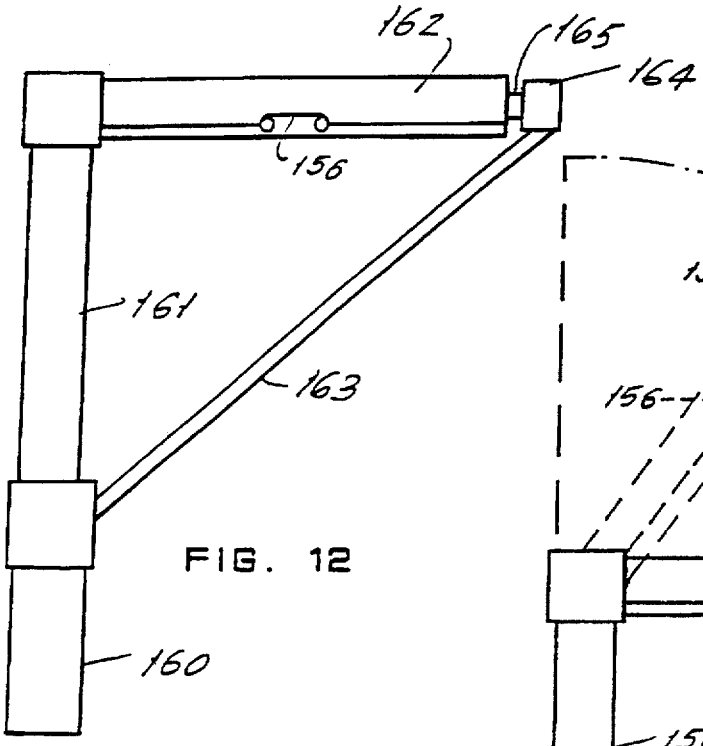
FIG. 12 schematically illustrates the use of the invention in a side rotation switch.

FIGS. 12 and 13 are elevation and top schematic views of the invention as applied to a conventional side rotation switch assembly. Thus, in FIGS. 12 and 13, there is a vertical stand 160 which 5 carries a vertical support insulator 161 which is rotatable and which carries an interrupter/disconnect switch blade assembly 162 which rotates between the schematically illustrated open and closed position of FIG. 13. A diagonal support insulator 163 provides support for the terminal/disconnect switch jaw contact 164 which engages and disengages with the blade end 165 of the interrupter/blade assembly 162. The operation sequence of the interrupter and of the blade contacts is the same as that previously described.

Figure 14:
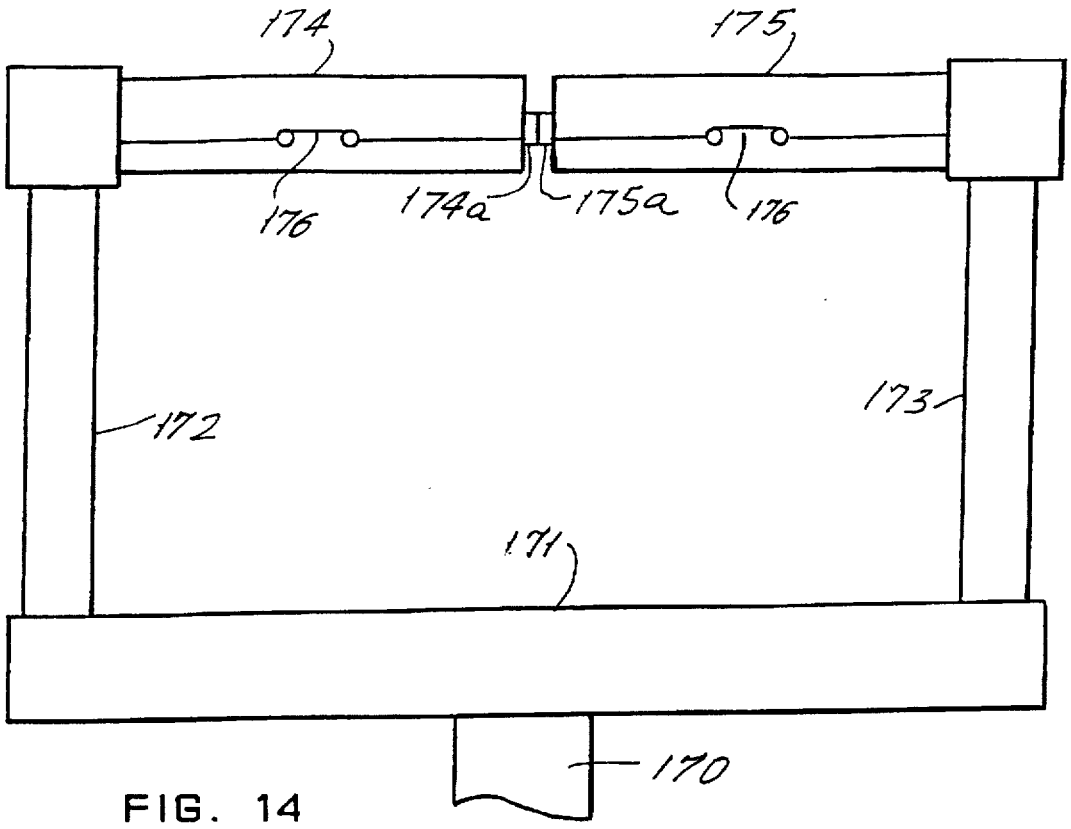
FIG. 14 schematically illustrates the use of the invention in a two-arm center break, lateral rotation design.
Figure 15:
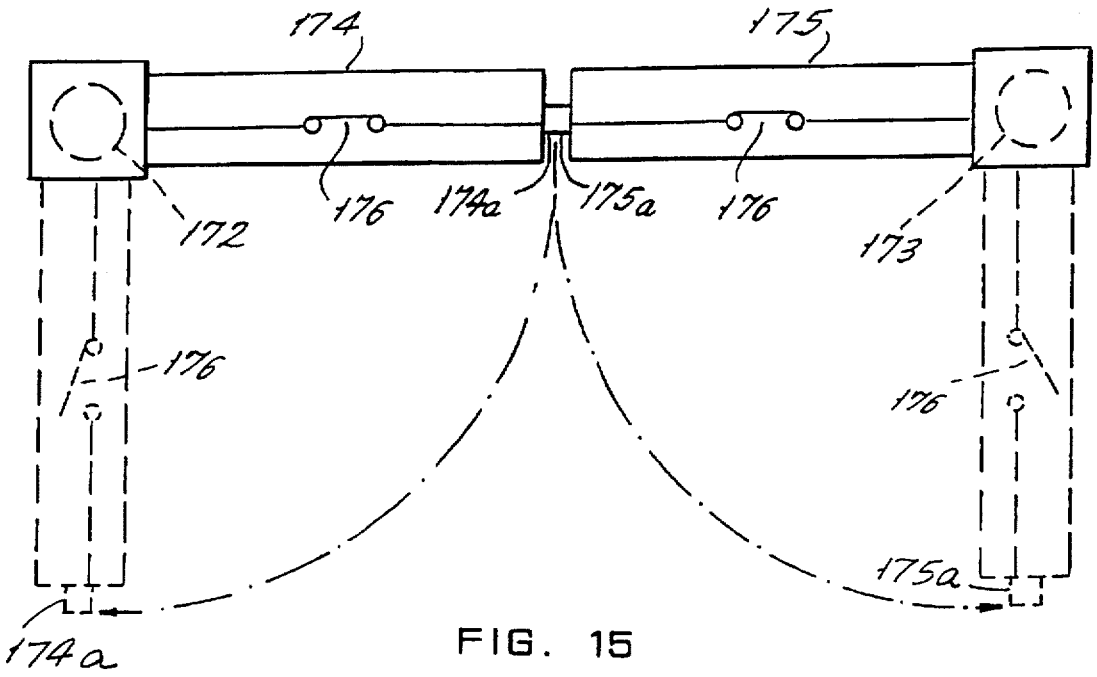
FIG. 15 is a top view of FIG. 14.

FIGS. 14 and 15 show the manner in which the invention is applied to a two-arm center break disconnect switch assembly. Thus, in FIG. 14, a vertical stand 170 supports a horizontal beam 171 which carries two rotatable insulators 172 and 173 at its outer extremities. Each of these rotatable insulators physically mount respective interrupter structure assemblies 174 and 175, respectively, which rotate, from the engaged position shown in solid lines in FIGS. 14 and 15, to the disengaged position shown in dotted lines in FIG. 15. Interrupter structure assemblies 174, 175 include interrupter contacts 176 which operate similarly to the manner in which interrupter contacts 156 shown in FIGS. 11–13 operate.

When in the engaged position, the extending contact blades 174a and 175a extend toward one another and engage one another in the closed position, and disengage one another after the interrupter structures 174 and 175 have opened and the assemblies 174 and 175 are rotated to the opened position of FIG. 15. Conventional contacts ordinarily used for two-arm center break designs are used in the positions of contacts 174a and 175a in carrying out the invention in the embodiment shown in FIGS. 14 and 15.

Figure 16:
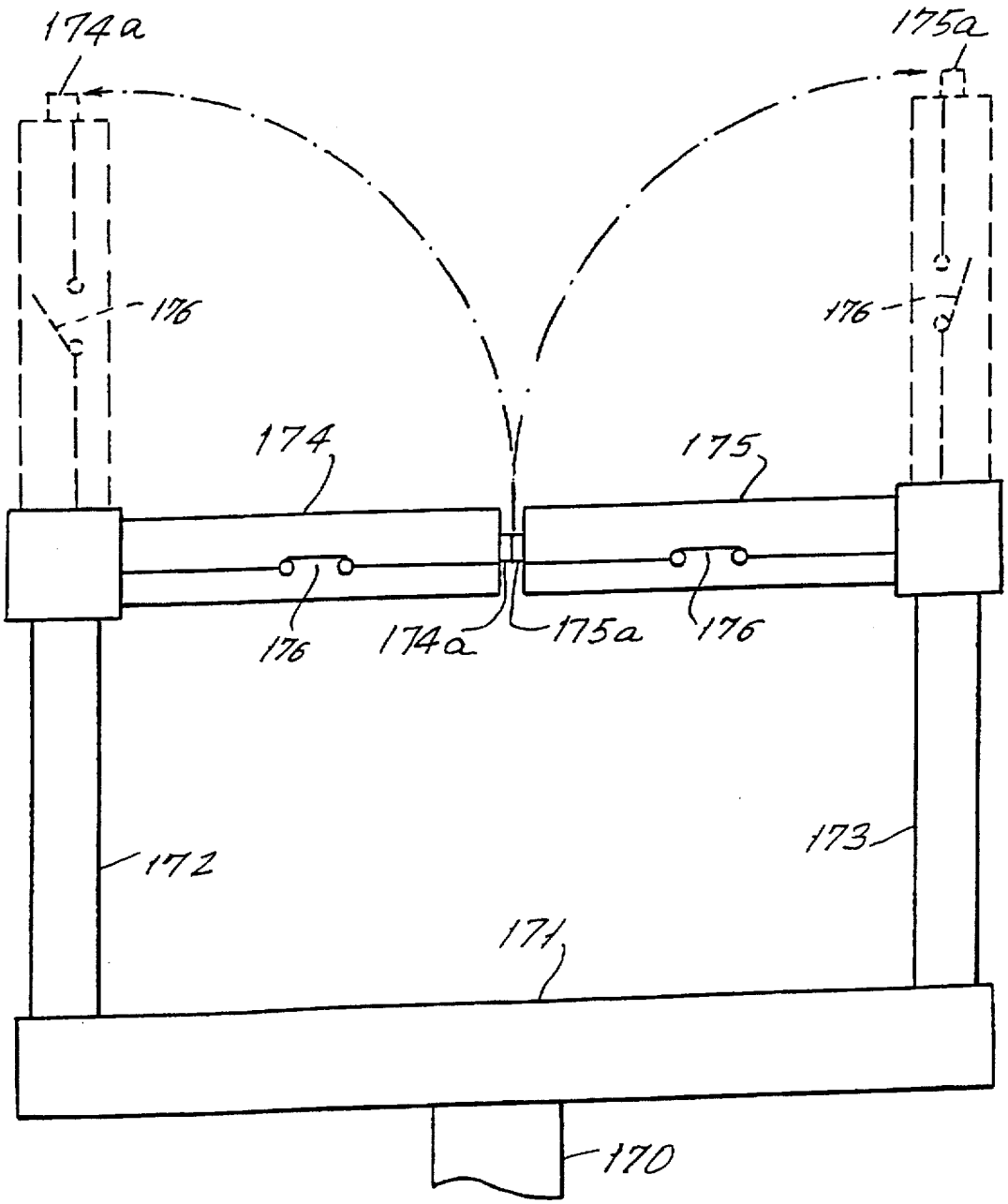
FIG. 16 schematically illustrates the use of the invention in a two-arm center break, vertical rotation design.

The two-arm center break design of FIGS. 14 and 15 can also be carried out as illustrated in FIG. 16, with the interrupters rotating vertically upwardly as compared to a horizontal rotation in a plane parallel to the plane of the support surface. Numerals identifying the same components of FIGS. 14 and 15 are also used in FIG. 16. Note, however, that the insulators 173 and 173 in FIG. 16 need not be rotatable insulators and that the plane of rotation of the interrupters 174 and 175 is vertical.

The invention and its advantages can also be carried out in a center pivot design, with the interrupter structures rotating in a vertical plane. Thus, in FIG. 17, a vertical support 180 carries a horizontal support structure 181 which supports a central insulator 182 and two outer insulators 183 and 184. Insulators 183 and 184 each carry jaw contacts 185 and 186, respectively, which receive the extending contact blades 187 and 188 of interrupter switch assemblies 189 and 190, respectively. The interrupter switch assemblies 189 and 190 are then rotatably mounted on the rotatable mounting casting 191, supported atop insulator 182. In operation, an operating mechanism, not shown but having linkages extending through insulator 182, will simultaneously operate the two switches 189 and 190 to an upper position, with the insulators swinging in parallel-spaced planes. As in the prior assemblies, the interrupter contacts 196 of interrupters 189 and 190 open before the vertical lifting motion of interrupters 189 and 190, and close after the interrupter assemblies are in their solid-line closed positions.

Figure 17:
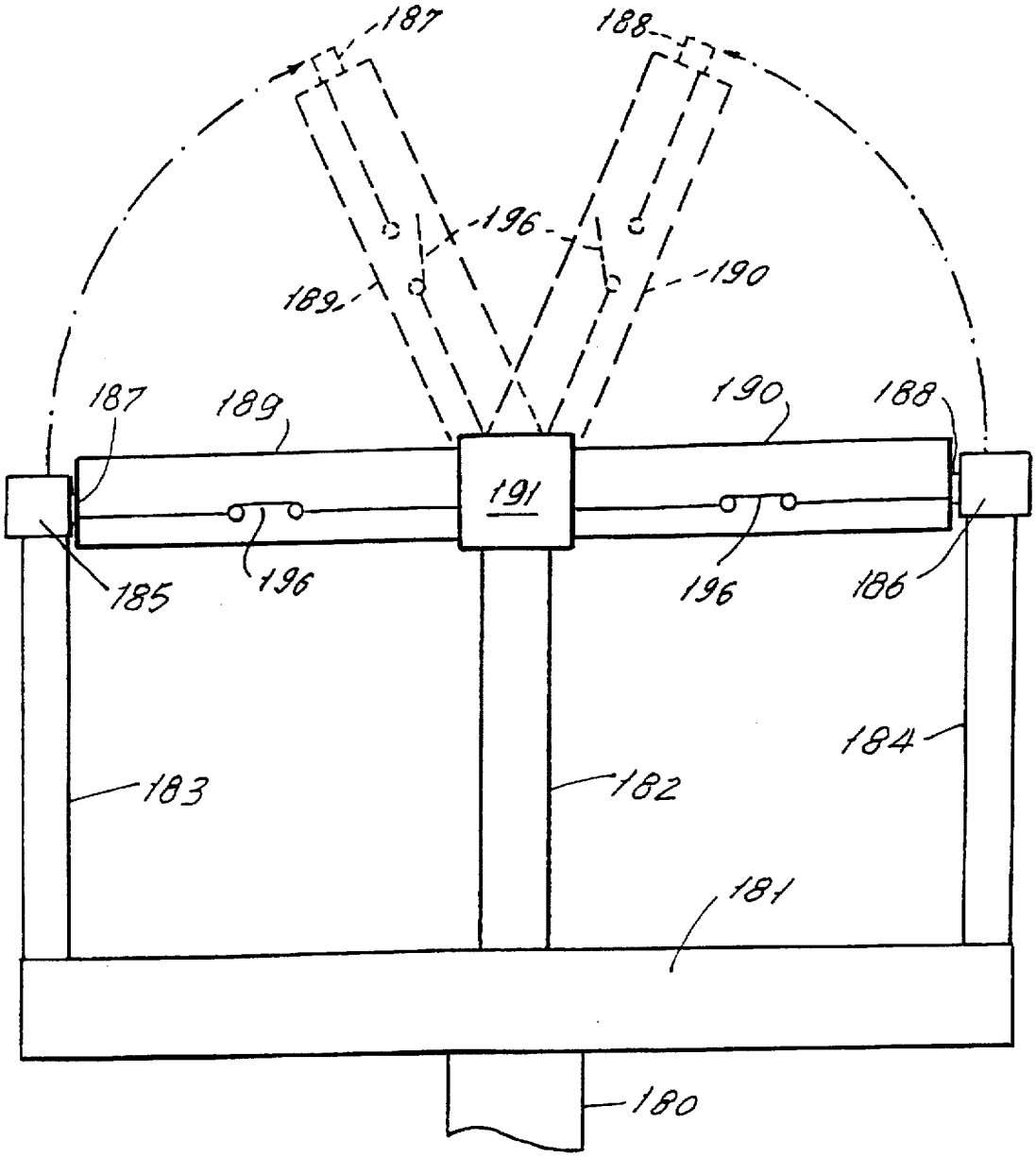
FIG. 17 schematically illustrates the use of the invention with a center pivot, vertical rotation design.
Figure 18:
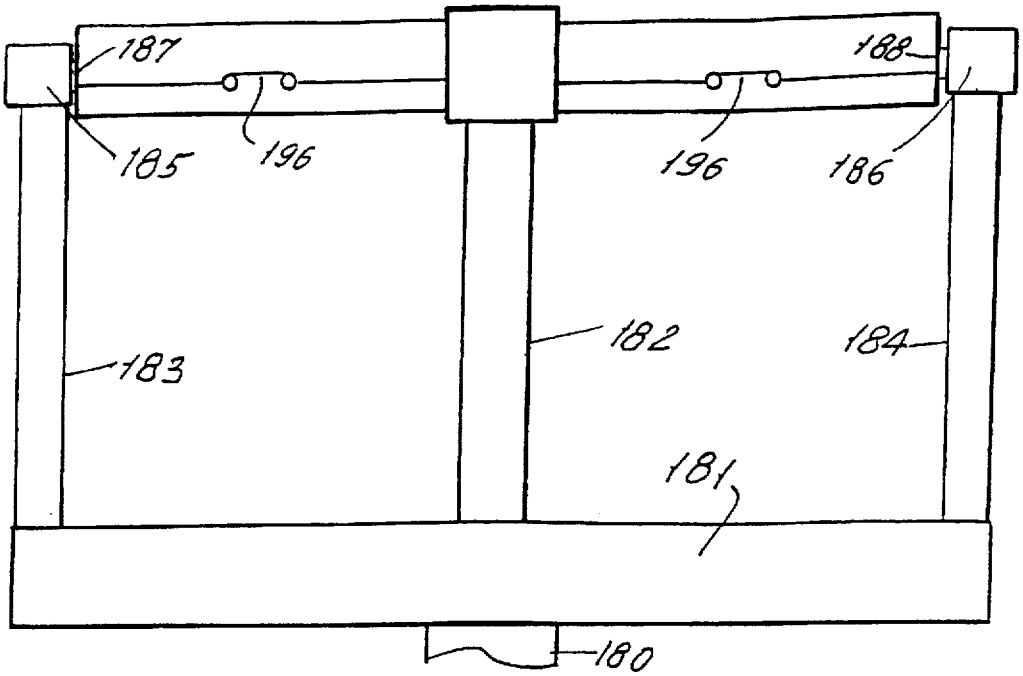
FIG. 18 schematically illustrates the use of the invention in a center pivot lateral rotation design.
Figure 19:
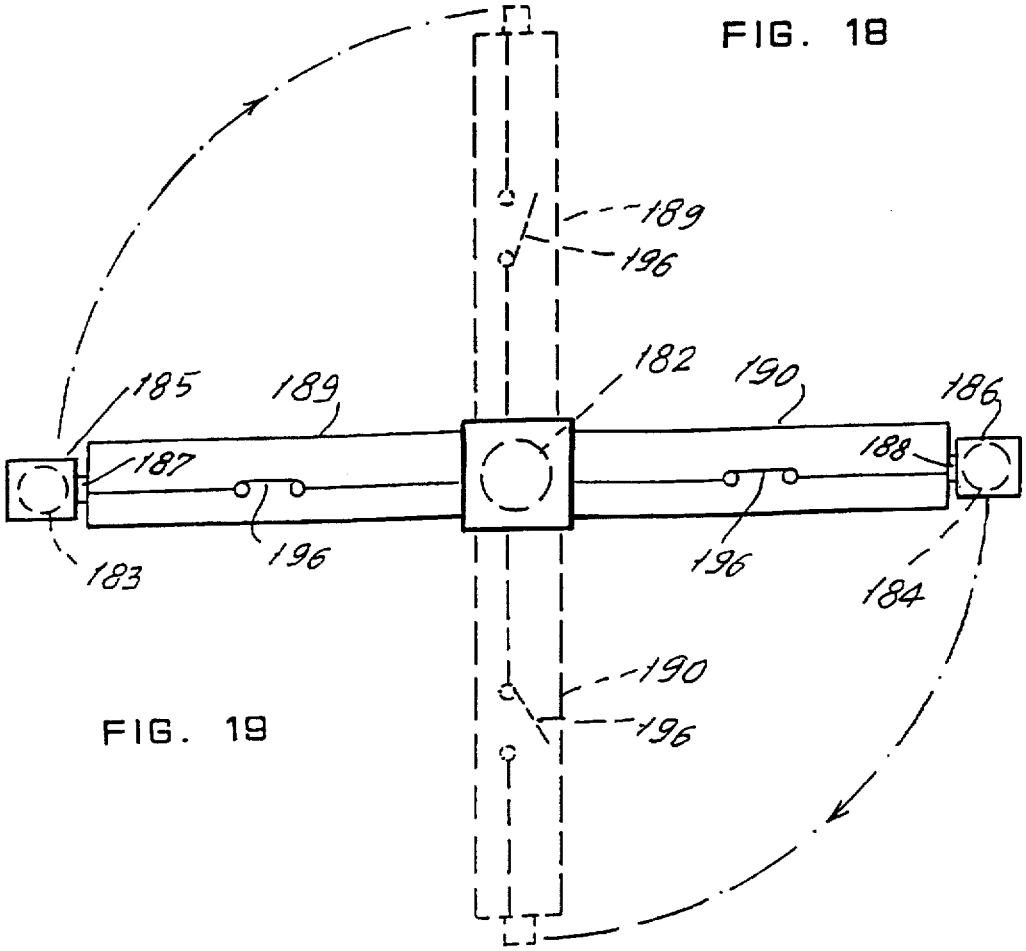
FIG. 19 is a side view of FIG. 18.

The center pivot design of FIG. 17 can also be carried out with the interrupter assemblies rotating in a horizontal plane, as shown in FIGS. 18 and 19. Thus, in FIGS. 18 and 19, similar numerals are applied to components which are similar to those of FIG. 17. However, in FIGS. 18 and 19, the interrupters 189 and 190 are so mounted that they rotate from the solid-line positions shown in FIG. 19 to the dotted-line position of FIG. 19 after the interrupter contacts have opened. To this end, a modified pivotal support is provided for the adjacent ends of interrupters 189 and 190, it being noted that the interrupters may be stacked atop one another so that they rotate in spaced-parallel planes.

In each of the embodiments disclosed herein, considerable substation space is saved by virtue of the arrangement of the interrupter switch assembly within the disconnect blade portion of the disconnect switch. Moreover, the disconnect switch assembly is a relatively lightweight assembly which may be mounted in a simple tube, and may have a BIL rating less than that of the disconnect switch portion of the device.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high voltage switch, comprising:

a) an open-air disconnect switch including:

1) first and second relatively movable contacts movable between a closed position and a large air-gap open switch position;

2) an elongated contact arm having first and second ends, wherein said first relatively movable contact is connected to said second end of said elongated arm;

b) a support pivot means connected to said first end of said elongated contact arm;

c) fixed support means for mechanically supporting said second relatively movable contact and for pivotally supporting said support pivot means;

d) an interrupter structure located within said elongated contact arm, the interrupter structure including:

1) an elongated rigid body;

2) a pair of relatively movable interrupter contacts movable between open and closed positions and connected to said elongated rigid body;

e) an operating mechanism including:

1) a first operating means connected to said elongated contact arm to rotate said elongated contact arm around said support pivot means to move said first and second contacts of said disconnect switch between their closed and open positions;

2) second operating means connected to at least one of said pair of contacts of said interrupter structure for moving said pair of relatively movable interrupter contacts of said interrupter structure between their said closed and open positions, said first and second relatively movable contacts of said disconnect switch connected in series with said pair of relatively movable interrupter contacts of said interrupter structure, wherein said operating mechanism actuates said first and second operating means to open said contacts of said interrupter structure before said contacts of said disconnect switch open, and to close said contacts of said disconnect switch and the contacts of said interrupter structure;

the BIL rating of said interrupter structure being lower than the BIL rating of said disconnect switch.

2. The switch of claim 1, further comprising a support stand for supporting said disconnect switch; a first vertical support insulator extending from said support stand and having a top end connected to and supporting said support pivot means, and further support means connected between said support stand and said second contact of said disconnect switch to fixedly support said second contact above said support stand.

3. The switch of claim 2, wherein said support stand is a horizontal beam.

4. The switch of claim 3, wherein said further support means comprises a vertical insulator support spaced from said first vertical support insulator and parallel thereto.

5. The switch of claim 1, further comprising a support stand for supporting said disconnect switch; a first vertical support insulator extending from said support stand and having a top end connected to and supporting said support pivot means, and further support means connected between said support stand and said second contact of said disconnect switch to fixedly support said second contact above said support stand.

6. The switch of claim 1, wherein said interrupter structure is a gas puffer interrupter contained within a rigid insulation tube.

7. The switch of claim 2, wherein said interrupter structure is a gas puffer interrupter contained within a rigid insulation tube.

8. The switch of claim 1, wherein said operating mechanism actuates said first operating means to move said first and second contacts of said disconnect switch at low speed and actuates said second operating means to move said first and second relatively movable contacts of said interrupter structure at a relatively higher speed.

9. The switch of claim 5, wherein said operating mechanism actuates said first operating means to move said first and second contacts of said disconnect switch at low speed and actuates said second operating means to move said interrupter contacts of said interrupter structure at a relatively higher speed.

10. The switch of claim 1, wherein said support pivot means includes a mechanism to rotate said elongated contact arm and said interrupter structure about a predetermined axis to move said first relatively movable contact of said disconnect switch into and out of engagement with said second relatively movable contact of said disconnect switch, and to rotate said-contact arm around its said first end to move its said second end into and out of said large gap open switch position.

11. The switch of claim 2, wherein said support pivot means includes a mechanism to rotate said elongated contact arm and said interrupter structure about a predetermined axis to move said first relatively movable contact of said disconnect switch into and out of engagement with said second relatively movable contact of said disconnect switch, and to rotate said contact arm around its said first end to move its said second end into and out of said large gap open switch position.

12. The switch of claim 8, wherein said support pivot means includes means to rotate said elongated contact arm and said interrupter structure about a predetermined axis to move said first relatively movable contact of said disconnect switch into and out of engagement with said second relatively movable contact of said disconnect switch, and to rotate said contact arm around its said first end to move its said second end into and out of said large gap open switch position.

13. A disconnect switch blade, comprising:

a) a rigid elongated body including:

1) a first end having a pivotal support means;

2) a second end having a contact blade operable to engage and disengage a stationary jaw contact when said rigid elongated body rotates around said pivotal support means; and b) an elongated interrupter structure fixed between said pivotal support means and said contact blade and forming an electrical conductor connected between said pivotal support means and said contact blade, the interrupter structure including a pair of separable contacts which are operable at a relatively high speed compared to the speed of rotation of said disconnect switch blade about said pivotal support means, the BIL rating of said interrupter structure being lower than the BIL rating of said disconnect switch.

14. The switch of claim 13, wherein said interrupter structure is a gas puffer interrupter contained within a rigid insulation tube.

15. A combined interrupter and disconnect switch blade for a high voltage switch, the combined interrupter and disconnect switch blade comprising:

a) a first end being connected to a pivotal support member;

b) a second end having a contact blade engaging and disengaging a stationary jaw contact when said second end is rotated about said pivotal support member;

c) an interrupter located between said first end and said second end for interrupting a current flowing between said first end and said second end; and d) the BIL rating of said interrupter structure being lower than the BIL rating of said disconnect switch.

* * * * *

UNITED STATES PATENT AND TRADEMARK OFFICE

CERTIFICATE OF CORRECTION

PATENT NO. : 5,696,364

DATED : December 9, 1997

INVENTOR(S) : Nicholas J. Stroud et al.

It is certified that error appears in the above-indentified patent and that said Letters Patent is hereby corrected as shown below:

Col. 3, line 3, before "21a" insert the word -support--

Col. 7, line 5, "insulators 173 and 173" should read-- insulators 172 and 173--

Signed and Sealed this

Tenth Day of March, 1998

Bruce Lehman

*Attest:*

BRUCE LEHMAN

*Attesting Officer*

*Commissioner of Patents and Trademarks*